United States Patent [19]

Ludszeweit

[11] Patent Number: 4,757,951

[45] Date of Patent: Jul. 19, 1988

[54] BOBBIN CHANGING APPARATUS

[75] Inventor: Dieter Ludszeweit, Hamburg, Fed. Rep. of Germany

[73] Assignee: Körber AG, Hamburg, Fed. Rep. of Germany

[21] Appl. No.: 932,917

[22] Filed: Nov. 19, 1986

[30] Foreign Application Priority Data

Nov. 23, 1985 [DE] Fed. Rep. of Germany ..... 3541456

[51] Int. Cl.[4] ..... B65H 19/18; B65H 16/10

[52] U.S. Cl. ..... 242/58.1; 242/58.6; 242/68.7; 242/79

[58] Field of Search ..... 242/58.6, 58.1, 79, 242/68.7, 75.1

[56] References Cited

U.S. PATENT DOCUMENTS

| | | | |
|---|---|---|---|
| 2,708,078 | 5/1955 | Shakely | 242/79 |
| 3,202,376 | 8/1965 | Dutro | 242/75.1 |
| 3,226,050 | 12/1965 | Engel | 242/79 |
| 3,351,299 | 11/1967 | Fehr | 242/79 |
| 3,698,658 | 10/1972 | Skei | 242/75.1 |
| 4,386,741 | 6/1983 | Weiss | 242/58.6 |
| 4,392,912 | 7/1983 | Horsley | 242/58.6 |

*Primary Examiner*—Stuart S. Levy

*Assistant Examiner*—Katherine Matecki

*Attorney, Agent, or Firm*—Peter K. Kontler

[57] ABSTRACT

Apparatus for changing bobbins of wrapping material in a cigarette making or packing machine has a magazine for a supply of fresh bobbins and a receptacle in front of the magazine. The receptacle receives from the magazine the foremost fresh bobbin when the web of wrapping material on the expiring bobbin is nearly exhausted. The expiring bobbin is located in a pocket between endless belt conveyors which are driven to unwind the web from the expiring bobbin. The fresh bobbin in the receptacle can be prepared for splicing of the leader of its web to the trailing end of the web on the expiring bobbin, and such splicing is carried out as soon as the trailing end of the web is separated from the fully expired bobbin. The core of the expired bobbin is ejected from the unwinding station before the fresh bobbin is transferred from the receptacle into the pocket between the driven belt conveyors by the pull of its web which is drawn into the consuming machine as well as by appropriate manipulation of the bottom part of the receptacle which can be designed to allow for a lowering of at least one of its components in a sense to induce a gravitational descent of the fresh bobbin from the receptacle into the unwinding station.

25 Claims, 2 Drawing Sheets

BOBBIN CHANGING APPARATUS

CROSS REFERENCE TO RELATED CASES

The present invention is related to those disclosed in the commonly owned copending patent applications Ser. Nos. 794,109 (filed by Heitmann on Nov. 1, 1985 for "Apparatus for locating, engaging and transporting the leader of convoluted cigarette paper or the like") and 796,563 (filed by Heitmann et al. on Nov. 8, 1985 for "Bobbin changing apparatus for use in tobacco processing machines").

BACKGROUND OF THE INVENTION

The present invention relates to a method of and to an apparatus for changing bobbins in machines wherein webs of convoluted wrapping or other material are processed continuously so that the machines must or should receive a continuous web of flexible strip material. Typical examples of machines which process continuous webs of wrapping or other material are cigarette rod making machines wherein the web forms the tubular wrapper of a continuous cigarette rod, filter rod making machines wherein the web forms the tubular wrapper of a continuous filter rod, and cigarette packing machines wherein arrays of cigarettes are draped into blanks to form cigarette packs or cartons of cigarette packs. In such machines, the webs must be fed at a high speed and without interruptions because any, even short, interruptions can entail huge losses in output. By way of example, a modern cigarette maker can turn out up to and in excess of 8000 cigarettes per minute so that a one-minute interruption results in a loss of approximately 40 cartons of cigarette packs.

One mode of maintaining a bobbin in proper position for unwinding is to mount the bobbin on a mandrel which extends through the hollow core of the bobbin. Another conventional mode of holding a bobbin in a position for unwinding is to force a rod through the core so that the rod is a tight fit in the core, and to place the end portions of the rod into a rack wherein the rod rotates with the bobbin in response to unwinding of the web. In accordance with a further proposal, the bobbin which is in the process of paying out the web is held by rollers which engage its periphery (i.e., the outermost convolution of the supply of web on the core). East German Pat. No. 43,784 discloses an apparatus wherein the bobbin which is about to pay out its web is placed onto a set of rollers and is held thereon for the purpose to prepare the leader of its web for slicing to the trailing end of the running web. The thus prepared bobbin is transferred to the unwinding station where two mandrels extend into its core from opposite axial ends in the course of the web unwinding operation.

A further mode of maintaining a bobbin in a position of readiness for unwinding of its web is disclosed in German Utility Model No. 1 888 719. The periphery of the bobbin is engaged by supporting rollers and the core of the freshly expired bobbin is expelled from the unwinding station in response to short-lasting retraction of one of the rollers. A lever is used to transfer a fresh bobbin from a position of readiness into the unwinding station.

Still another apparatus for supporting a bobbin in the course of the unwinding operation is disclosed in commonly owned U.S. Pat. No. 3,279,717 to Schubert. This apparatus is particularly suited for manipulation of bobbins which carry supplies of thin or very thin web- or strip-shaped material, such as cigarette paper. The bobbin at the unwinding station is supported by a belt conveyor which is driven at a speed slightly less than the speed of the withdrawing rolls so as to maintain the web under tension.

All of the above described conventional apparatus exhibit one or more drawbacks, particularly as concerns the possibility of automating the bobbin changing operation which is desirable in modern production lines serving to turn out large quantities of goods which are draped into or contain a flexible web or strip material containing or consisting of paper, metallic foil, plastic foil or the like.

OBJECTS AND SUMMARY OF THE INVENTION

An object of the invention is to provide a novel and improved method of manipulating bobbins or reels of convoluted web or strip material, especially relatively thin and weak web material which must be fed to one or more consuming or processing machines at a high speed and without interruptions.

Another object of the invention is to provide a method which renders it possible to automatically admit a fresh bobbin to the unwinding station without the need for mechanical pushing or pulling devices.

A further object of the invention is to provide a method which renders it possible to automatically transfer a fresh bobbin to the unwinding station of a cigarette rod making, cigarette packing, filter rod making or other machine as soon as the supply of web on the preceding bobbin is exhausted.

Still another object of the invention is to provide a novel and improved apparatus for the practice of the above outlined method and to construct and assemble the apparatus in such a way that splicing of the leader of a fresh web to the trailing end of the preceding web automatically entails or assists in the transfer of the bobbin with the fresh web into the unwinding station.

An additional object of the invention is to provide the apparatus with novel and improved unwinding means and with novel and improved means for maintaining successive fresh webs in a position of readiness for transfer to the unwinding station.

Another object of the invention is to provide an apparatus wherein the expiring bobbin need not rotate about a fixed axis in the course of the unwinding operation.

A further object of the invention is to provide a machine or a production line which embodies the above outlined apparatus.

An additional object of the invention is to provide an apparatus which can manipulate large or small bobbins, as well as bobbins of wide or narrow web material, with the same facility and reliability.

One feature of the invention resides in the provision of a method of changing bobbins each of which has a core and a web which is convoluted on the core, the leader of which is part of the outermost convolution of the web and the trailing end of which is adjacent and can be secured to the core. The method comprises the steps of establishing a supply of fresh bobbins, maintaining an expiring bobbin at an unwinding station and unwinding the web of the expiring bobbin so that the diameter of the expiring bobbin decreases, transferring a fresh bobbin from the supply to a second station (preferably closely adjacent the unwinding station) and holding the transferred fresh bobbin at the second station including engaging the outermost convolution of the transferred bobbin, preparing the leader of the web at the second station for attachment to the trailing end of the web at the unwinding station, splicing the leader of the web at the second station to the trailing end of the web at the unwinding station upon expiration of the bobbin at the unwinding station so that the web at the second station is drawn off its core by the web which is spliced to its leader, expelling the core of the expired bobbin from the unwinding station, and transferring the bobbin from the second station to the unwinding station at least partially as a result of the pull exerted by the web which is attached to the leader of the web of the bobbin at the second station.

The method preferably further comprises the steps of supporting the transferred bobbin at the unwinding station including engaging the outermost convolution of the respective web, and rotating the bobbin at the unwinding station to pay out its web. The rotating step can include pulling the web of the transferred bobbin at the unwinding station in a predetermined direction so that the bobbin tends to leave the unwinding station, and such method further comprises the step of applying to the bobbin at the unwinding station a force which prevents the bobbin from leaving the unwinding station. This force can be applied by two or more endless belt conveyors which define a pocket for the bobbin at the unwinding station.

The supporting step can include engaging the outermost convolution of the web at the unwinding station at a plurality of spaced-apart locations, and the applying step includes applying the force at one of the locations. The rotating step can include applying to the bobbin at the unwinding station torque at one of such locations. If desired, the torque and the force can be applied at each location where the outermost convolution of the web at the unwinding station is contacted by endless belt conveyors or the like. The arrangement is preferably such that the torque is applied to the upper portion of the outermost convolution of the web at the unwinding station.

Another feature of the invention resides in the provision of an apparatus for changing bobbins each of which has a core and a web which is convoluted on the core, the leader of which is part of the outermost convolution and the trailing end of which is adjacent the core. The apparatus comprises a source of supply of fresh bobbins (for example, a magazine which can contain a substantial supply of properly aligned fresh bobbins), a receptacle, means for delivering individual bobbins seriatim from the source to the receptacle, an unwinding device which defines an unwinding station and has means for withdrawing the web from the bobbin at such station, and means for splicing the leader of the web in the receptacle to the trailing end of the web at the unwinding station upon expiration of the bobbin at the unwinding station so that the trailing end of the freshly separated web pulls the web and its bobbin in the receptacle in a predetermined direction toward and into the unwinding station. The unwinding device preferably further comprises means for supporting the bobbin at the unwinding station, including means for contacting the outermost convolution of the web at the unwinding station at two spaced-apart locations such that the tangents to the locations of the outermost convolution at the unwinding station form a pocket facing substantially counter to the predetermined direction. The withdrawing means can comprise two mutually inclined unwinding members, and each unwinding member can comprise at least one endless belt conveyor. At least one of the unwinding members can comprise a plurality of endless belt conveyors. The unwinding members preferably make an acute angle, and such unwinding members can constitute the aforementioned supporting means, i.e., they can define the aforementioned pocket.

The receptacle can comprise means for engaging the outermost convolution of the web in the receptacle. Such engaging means can comprise a plurality of substantially vertically movable supporting members which engage the outermost convolution of the web in the receptacle from below. At least one of the supporting members can include at least one rotary component in the form of a roller or wheel. The receptacle can further comprise means for moving the supporting members up and down independently of each other, and such moving means can include fluid-operated motors.

The receptacle and the unwinding device are preferably adjacent each other, and the receptacle is preferably arranged to allow the bobbin which is held therein to enter the unwinding station by gravity in response to lowering of at least one supporting member so that the force of gravity assists the pull of the trailing end which is spliced to the leader of the web in the receptacle in transferring the bobbin from the receptacle to the unwinding station.

The unwinding device can further comprise means for driving the supporting means so as to unwind the web from the core at the unwinding station. The means for driving can include means for unwinding the web at the unwinding station at a first speed, and the withdrawing means can comprise means for drawing the web from the unwinding station at a higher second speed so that the web is tensioned between the withdrawing means and the supporting means. The supporting means can comprise discrete supporting elements which engage the outermost convolution of the web at the unwinding station at the aforementioned plurality of locations, and the driving means can comprise means for driving the supporting elements at different speeds.

The apparatus can further comprise means for holding the core at the unwinding station prior to expiration of the respective bobbin. The cores of the bobbins are preferably hollow, and the holding means can comprise a mandrel and means for introducing the mandrel into the core at the unwinding station. The introducing means can comprise a motor, particularly a fluid-operated motor.

The apparatus can further comprise means for expelling the core from the unwinding station upon expiration of the respective bobbin. The expelling means can comprise a pusher and means for moving the pusher, preferably a fluid-operated motor.

The invention also resides in the provision of an apparatus for unwinding bobbins of the type wherein a core is surrounded by the convolutions of a web. The apparatus comprises an unwinding device having means for supporting the outermost convolution of the bobbin at a plurality of spaced-apart locations such that the tangents to the outermost convolution at these locations define a pocket which is open in a predetermined direction, and means for drawing the web off the core in the unwinding device counter to such direction. The supporting means can comprise a plurality of endless belt conveyors which contact the outermost convolution of the web at the aforementioned locations and make an acute angle in the region of the pocket. The apparatus further comprises means or driving at least one of the conveyors in a direction to unwind the web from its core.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
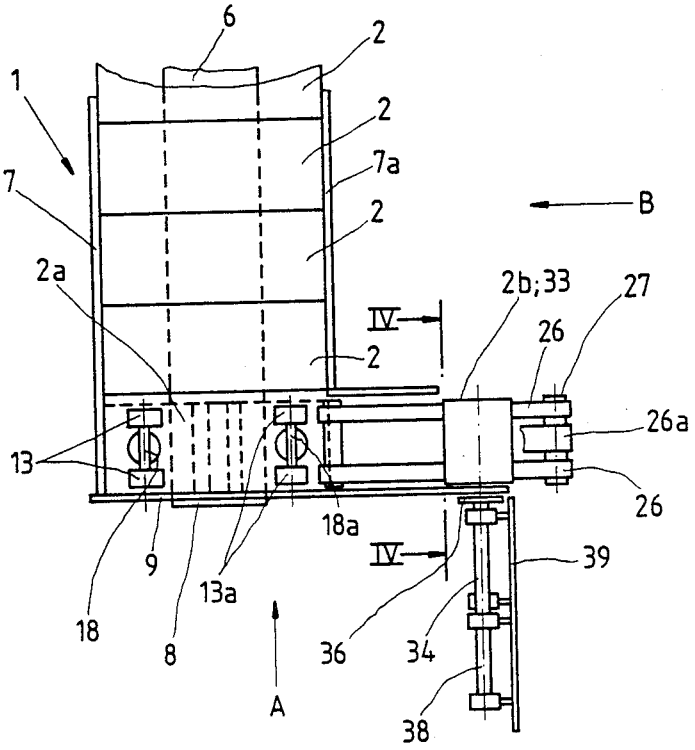
FIG. 1 is a plan view of an apparatus which embodies one form of the invention.
Figure 3:
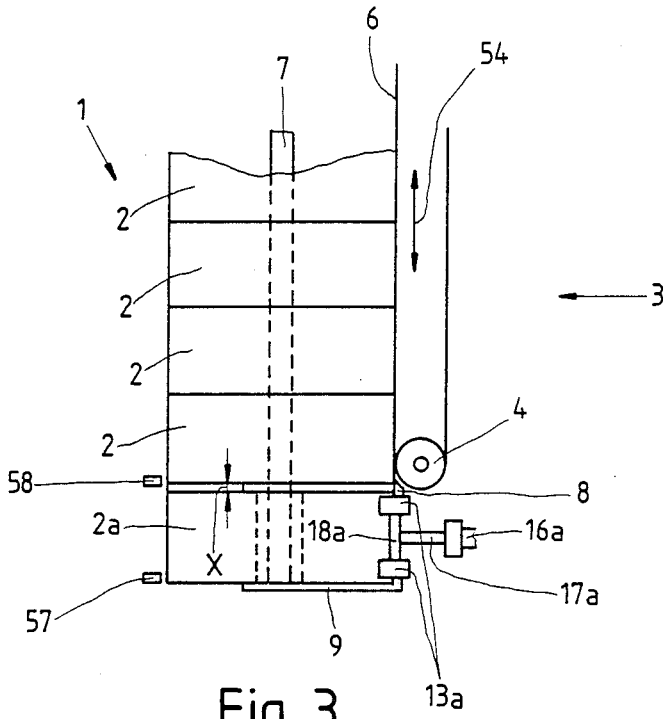
FIG. 3 is a fragmentary side elevational view of the apparatus as seen in the direction of arrow B in FIG. 1.

Referring first to FIGS. 1 and 3, there is shown a bobbin changing apparatus which comprises a magazine 1 constituting a source of supply of closely adjacent fresh bobbins 2 each of which comprises a hollow core 33 and an elongated web 19 of cigarette paper or other wrapping material. The trailing end of each convoluted web 19 is adjacent and is often adhesively secured or otherwise attached to the respective core 33, and the leader of each web 19 forms part of the outermost convolution of the respective web and is normally secured to the adjacent portion of the web by a strip of adhesive tape (not specifically shown) or the like. The dimensions of the magazine 1 can be selected in such a way that it can store a substantial supply of fresh bobbins 2, for example, a supply which is consumed during an eight-hour shift or during an entire day of operation of the web-processing machine, such as a cigarette rod making machine, a filter rod making machine or a cigarette packing machine, not shown. For example, the machine which receives webs 19 from the apparatus of the present invention can constitute a cigarette maker of the type known as PROTOS which is manufactured by the assignee of the present application.

The bobbins 2 in the magazine 1 are disposed in neighboring vertical planes and their hollow cores 33 are coaxial (their common axis is or can be located in a horizontal plane). The bottom 3 of the magazine 1 includes an endless belt conveyor 6 which is trained over several pulleys 4 (only one shown in FIGS. 2 and 3) and is driven by a reversible motor (not shown) so that it can move its upper reach or flight in directions which are indicated by the arrow 54 (see FIG. 3). Elongated horizontal guide members 7 and 7a are used to ensure that the fresh bobbins 2 in the interior of the magazine 1 are held in proper axial alignment with each other.

The apparatus further comprises a receptacle 12 which is adjacent the front end of the magazine 1 and defines a station for temporary storage of successive fresh bobbins 2 before such bobbins are transferred to an unwinding station 21. The receptacle 12 comprises a horizontal table 8 which is adjacent the front end of the belt conveyor 6 and cooperates with two vertically movable rotary components 13 and 13a in the form of individual or plural wheels or rollers which serve to engage the outermost convolution of the fresh bobbin 2a resting on the table 8 and form part of a bobbin holding or supporting device 11. The table 8 is adjacent to or comprises a stationary stop 9 which arrests the oncoming foremost fresh bobbin 2a in a predetermined position for convenient transfer to the unwinding station 21. The rotary components 13 and 13a can lift the foremost bobbin 2a off the table 8 so that the bobbin can be freely rotated while its outermost convolution is out of contact with the top surface of the table. This facilitates the transfer of such bobbin into the unwinding station 21. The purpose of the receptacle 12 is to facilitate the preparation of a fresh bobbin 2a therein for attachment of the leader of its web 19a to the trailing end of the web 19 on the expiring bobbin 2b at the unwinding station. The splicing operation is carried out by a splicing device 41, for example, a device corresponding to that shown in commonly owned U.S. Pat. No. 3,586,006 granted June 22, 1971 to Wendt. The disclosure of this patent is incorporated herein by reference. The rotary components 13 and 13a are movable up and down by separate drives 14, 14a which preferably comprise fluid-operated motors 16, 16a, respectively. Each of the motors 16, 16a can constitute a double-acting pneumatic or hydraulic cylinder and piston unit of any known design. The motors 16 and 16a are operable independently of each other so that the rotary component 13a can be raised or lowered independently of the rotary component 13 and vice versa. The piston rods 17, 17a of the motors 16, 16a can comprise bifurcated upper end portions for the shafts 18, 18a (see FIG. 1) of the rotary components 13 and 13a.

The unwinding station 21 is defined by an unwinding device 22 which is immediately or closely adjacent the station defined by the receptacle 12. The unwinding device 22 receives a fresh bobbin 2a from the receptacle 12 as soon as the preparation for the splicing of the web 19a of the fresh bobbin 2a to the web 19 of the expiring bobbin 2b at the station 21 is completed and as soon as the leader of the web 19a is properly spliced to the trailing end of the web 19. The unwinding device 22 comprises two similar or identical unwinding units 23, 23a each of which comprises an unwinding member (26, 26a) including one or more endless belt conveyors which form part of the means for unwinding the web 19 from the expiring bobbin 2b at the station 21. Such unwinding or web withdrawing means further comprises two driven rollers 49 which pull the web 19 in the direction indicated by an arrow 32. Such arrow further indicates the direction of pull upon the leader of the web 19a as soon as this leader is attached to the trailing end of the web 19 at the station 21.

Figure 2:
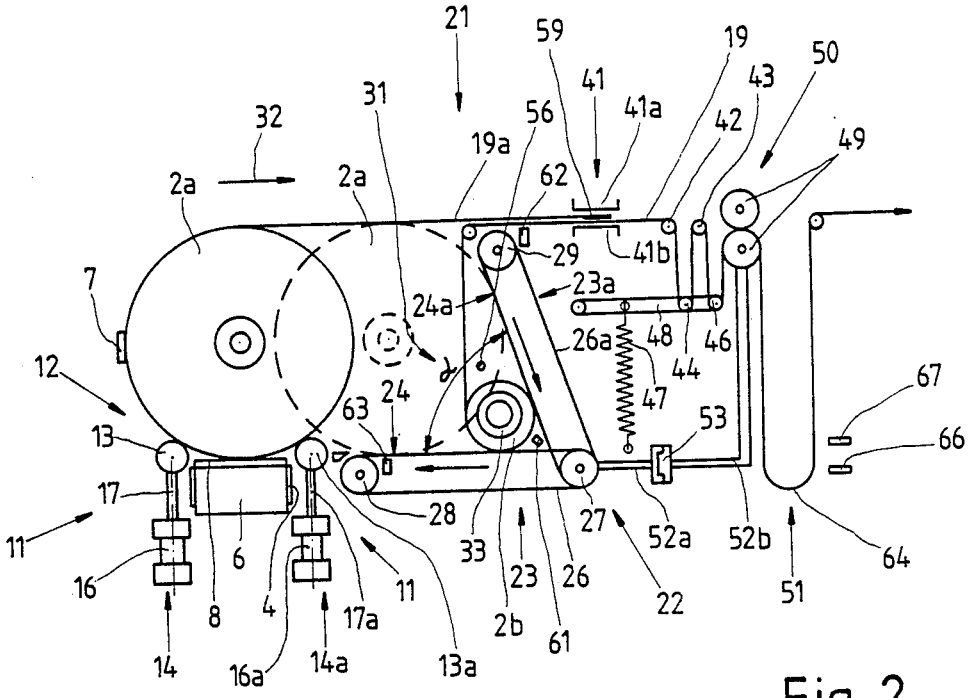
FIG. 2 is a fragmentary front elevational view of the apparatus as seen in the direction of arrow A in FIG. 1.

As can be seen in FIG. 1, the lower unwinding unit 23 preferably comprises two parallel endless belt conveyors 26 which are trained over a first pulley 28 and over a second pulley 27 which is common to the units 23 and 23a. The unit 23a comprises a single endless belt conveyor 26a (see FIG. 1) which is trained over the aforementioned pulley 27 as well as over an additional pulley 29. The neighboring reaches or flights of the belt conveyors 26 and 26a define a pocket 31 (note the angle $\alpha$) which is open toward the station defined by the receptacle 12, i.e., counter to the direction which is indicated by the arrow 32. The angle is preferably a relatively large acute angle. The left-hand flight of the conveyor 26a travels downwardly and the upper flight of each conveyor 26 travels in a direction to the left, as seen in FIG. 2, so that these flights tend to unwind the web 19 from the expiring bobbin 2b resting on the upper flights of the belt conveyors 26 and being further contacted by the left-hand flight of the belt conveyor 26a. The provision of a pocket 31 between the belt conveyors 26 and 26a ensures proper retention and holding of the expiring web 2b at the station 21 in the course of the entire unwinding operation, namely starting with the transfer of a fresh web 2a from the receptacle 12 into the pocket and terminating with separation of the trailing end of the respective web from the adjacent hollow core 33.

The diameter of the expiring bobbin 2b at the station 21 is already small, i.e., this bobbin is about to expire so that the leader of the web 19a forming part of the bobbin 2a in the receptacle 12 is or should be ready to be spliced to the trailing end of the web 19 as soon as the trailing end of the web 19 is detached from the respective core 33 or as soon as a suitable detector (for example, a photoelectronic transducer) transmits a signal indicating imminent or completed exhaustion or expiration of the supply of web 19 on the core 33 of the bobbin 2b. The core 33 of the bobbin 2b must be expelled from the station 21 prior to transfer of the next-following fresh web 2a from the receptacle 12 into the unwinding device 22. The means for expelling the core 33 of the bobbin 2b from the station 21 comprises a reciprocable expelling device in the form of a pusher 36 (see particularly FIG. 4) which is reciprocable by a moving means 34 in the form of a fluid-operated motor, for example, a double-acting pneumatic or hydraulic cylinder and piston unit.

Figure 4:
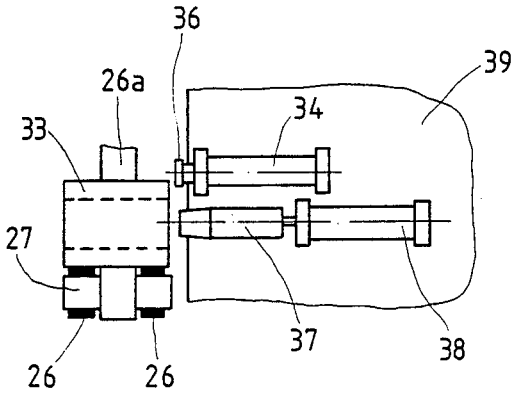
FIG. 4 is a sectional view as seen in the direction of arrows from the line IV—IV of FIG. 1.

FIG. 4 further shows a mandrel 37 which constitutes a means for holding the core 33 of the bobbin 2b at the station 21 for an interval of time shortly prior to and during actual expiration of the web 19. This ensures that the trailing end of the web 19 can be properly spliced to the prepared leader of the web 19a on the core 33 of the bobbin 2a in the receptacle 12. The purpose of the mandrel 37 is to securely hold the core 33 of the bobbin 2b at the station 21 prior to complete expiration of the web 19 so that the web 19 cannot extract or otherwise remove or expel the core 33 of the bobbin 2b from the station 21 prior to completion of the splicing operation. The motors 34 and 38 for the pusher 36 and the mandrel 37, respectively, are mounted on a frame 39. The motor 38 is or can be a fluid-operated motor similar to the motor 34.

The illustrated splicing device 41 comprises two splicing jaws 41a and 41b at least one of which is caused to move toward the other jaw when the splicing operation is started. At such time, the leader of the web 19a carries a strip of adhesive-coated tape 59 which is caused to bond the leader of the web 19a to the trailing end of the web 19 in response to movement of the jaw 41a toward the jaw 41b and/or vice versa.

When the splicing operation is completed, the trailing end of the web 19 pulls the leader of the web 19a along a predetermined path and through a first reservoir 50 which serves for temporary storage of a selected length of wrapping material before the web enters the consuming machine, such as a cigarette maker, a filter rod making machine or a cigarette packing machine. The just mentioned path is defined by two idler rollers 42, 43 which are rotatable about fixed axes, two dancer rollers 44 and 46 which are mounted on a pivotable lever 48 biased clockwise by a coil spring 47, and the aforementioned web withdrawing or unwinding means including the rollers 49. The nip of the rollers 49 is followed by a second reservoir 51 which stores a larger supply of wrapping material ahead of the location where the web enters the consuming machine.

The pulley 27 can be said to constitute one element of the means for driving the endless belt conveyors 26 and 26a which contact the outermost convolution of the freshly transferred bobbin 2a (indicated in FIG. 2 by broken lines) at the station 21 at two spaced-apart locations 24 and 24a. The location 24a is disposed at a level above the axis of the freshly transferred bobbin 2a. The means for driving the unwinding rollers 49 comprises a power train 52a, 52b the two branches of which can be coupled to each other by a disengageable clutch 53. The arrangement is preferably such that the peripheral speed of the unwinding rollers 49 at least slightly exceeds the speed of the endless belt conveyors 26, 26a so as to ensure that the web 19 or 19a is tensioned during travel of its increments between the unwinding station 21 and the reservoir 51. If desired or necessary, the means for driving the belt conveyors 26, 26a can be designed in such a way that the speed of the conveyors 26 exceeds the speed of the conveyor 26a or vice versa. The difference between the speeds of the conveyors 26 on the one hand and the conveyor 26a on the other hand need not be pronounced.

It is further possible to replace the illustrated power train 52a, 52b with two discrete drives, one for the rollers 49 and the other for the pulley 27. Such separate drives can be operated by suitable controls which ensure that the speed differential between the rollers 49 and the belts 26, 26a suffices to ensure adequate tensioning of the web 19 or 19a between the reservoir 51 and the unwinding station 21.

The conveyors 26 and 26a are designed to perform several functions, namely to rotate the bobbin 2b or 2a at the unwinding station 21 in a direction to pay out the web 19 or 19a as well as to prevent extraction or expulsion of the bobbin 2b or 2a from the unwinding station. This is due to the fact that the conveyors 26, 26a define the aforementioned pocket 31 whose open end faces counter to the direction which is indicated by the arrow 32, i.e., counter to the direction of travel of successive increments of the web 19 or 19a from the unwinding station 21 into the web consuming or processing machine. The feature that the conveyor 26a engages the outermost convolution of the web 19 or 19a at the location 24a which is disposed at a level above the axis of such bobbin is desirable and advantageous because this ensures that the bobbin at the station 21 invariably tends to enter the deepmost portion of the pocket 31 and is highly unlikely to leave the station 21 as a result of exertion of a pull upon its web 19 or 19a.

An advantage of a pocket 31 which is defined by belt conveyors (26, 26a) whose respective flights define an acute angle $\alpha$ is that the position of the bobbin in the pocket is stable during each stage of the unwinding operation, i.e., while the diameter of the supply of convoluted web material is large as well as immediately prior to expiration of the supply of web. A pocket 31 which defines an acute angle is desirable on the additional ground that, when the withdrawal of a web is interrupted for any one of a number of different reasons, the kinetic energy of the bobbin at the station 21 urges the bobbin deeper into the pocket so that the bobbin is arrested practically instantaneously and without any, or with negligible, slippage of its outermost convolution relative to the conveyors 26 and 26a.

Mounting of the bobbin 2a in the receptacle 12 on several rotary components (13, 13a) in the form of rollers or wheels which can lift the bobbin above the table 8 enables an operator to manipulate the bobbin 2a, and particularly the leader of its web 19a with a minimum of effort. Such manipulation can involve rotation of the entire bobbin 2a about its axis in order to withdraw a leader of requisite length for trimming, for the application of the adhesive strip 59 and for introduction into the splicing device 41.

The mandrel 37 ensures reliable separation of the trailing end of the web 19 or 19a at the unwinding station 21 from the respective core 33 so that the trailing end can be detected by a sensor 62 which then initiates the start of the splicing operation.

The pusher 36 can be replaced with other expelling or ejecting means without departing from the spirit of the invention. For example, a pivotable lever can be used in lieu of a reciprocable expelling device.

The novel unwinding device 22 with its conveyors 26, 26a can be used in other types of bobbin manipulating and unwinding apparatus, i.e., in apparatus which need not receive fresh bobbins from a receptacle of the type shown at 12 in FIG. 2.

The mode of operation of the improved apparatus is as follows:

If a fresh bobbin 2a is to be transferred from the magazine 1 onto the table 8 of the receptacle 12, the belt conveyor 6 at the bottom 3 of the magazine 1 is started to move the entire column of fresh bobbins 2 in a direction toward the stationary stop 9, and such movement of the conveyor 6 is terminated when the front side of the foremost fresh bobbin 2a abuts the stop 9. This ensures that the fresh bobbin 2a is in an optimum position for transfer into the unwinding station 21. The conveyor 6 is started in response to a signal which is transmitted by a sensor 56 (see FIG. 2) serving to monitor the diameter of the expiring bobbin 2b at the unwinding station 21. The sensor 56 is preferably designed to transmit a signal shortly before the supply of web 19 on the core 33 of the bobbin 2b is exhausted. At such time, the mandrel 37 holds the core 33 of the bobbin 2b against expulsion or extraction from the unwinding station 21. In the next step, the direction of movement of the conveyor 6 in the magazine 1 is reversed so that the entire column of fresh bobbins 2 behind the foremost bobbin 2a is moved rearwardly so as to establish a relatively narrow clearance or gap X (see FIG. 3) which allows for rotation of the bobbin 2a independently of bobbins 2 in the magazine 1 proper. The means for initiating a rearward movement of the supply of bobbins 2 in the magazine 1 and for terminating such rearward movement includes two sensors 57, 58 which are shown in FIG. 3 adjacent the table 8. The sensor 57 transmits a signal when the front face of the fresh bobbin 2a reaches the stop 9, so that the direction of movement of the belt conveyor 6 is reversed, and the sensor 58 transmits a signal when it detects that the width of the gap X has reached the desired value. The gap X ensures that the fresh bobbin 2a can be rotated relative to the table 8 and relative to the bobbins 2 in the magazine 1 as soon as the rotary components 13 and 13a have lifted the bobbin 2a above the table 8.

The sensor 58 can also initiate the operation of the motors 16 and 16a which engage the outermost convolution of the fresh bobbin 2a and lift this bobbin at least slightly above the table 8. The bobbin 24a is then ready for preparation which is necessary in order to ensure proper splicing of the leader of its web 19a to the trailing end of the web 19 which is being drawn off the core 33 of the expiring bobbin 2b at the unwinding station 21. The preparation can involve removal of the adhesive strip which connects the leader of the web 19 to the adjacent convolution, trimming of the separated leader, threading of the properly trimmed leader into the splicing device 41, and the application of adhesive strip 59 which is used to bond the leader of the web 19a to the trailing end of the web 19 as soon as the jaw 41a of the splicing device 41 is caused to move toward the jaw 41b and/or vice versa.

The just described operations, which involve preparation of the leader of the web 19a for splicing to the trailing end of the web 19, can be carried out by hand. However, it is equally within the purview of the invention to employ automatic or semi-automatic means of any known design in order to lift the leader of the web 19a off the adjacent convolution, to trim the lifted leader, to provide the lifted leader with an adhesive strip 59 and to thread the leader of the web 19a into the splicing device 41. The assignee of the present application owns numerous United States and foreign patents dealing with the preparation of the leader of a web of convoluted wrapping material for splicing to the web on an expiring bobbin or reel.

The unwinding station 21 accommodates a further sensor 61 which transmits a signal to the motor 38 for the mandrel 37 when the diameter of the convoluted material on the core 33 of the bobbin 2b is reduced to a predetermined value. At such time, the motor 38 pushes the mandrel 37 into the hollow core 33 of the bobbin 2b at the station 21 so as to prevent such core from leaving the station 21 in an uncontrolled or unpredictable manner. The mandrel 37 need not be withdrawn from the core 33 at the station 21 prior to separation of the trailing end of the web 19 from such core. In fact, the mandrel 37 can remain in the extended position while the pusher 36 is moved forwardly to expel the core 33 from the unwinding device 22.

The sensor 62 is adjacent the path of travel of web 19 from the respective core 33 toward the splicing jaws 41a and 41b. The sensor 62 detects the trailing end of the separated web 19 and initiates the operation of the splicing device so that the leader of the web 19a is properly bonded to the trailing end of the web 19 and the web 19a begins to advance in the direction of the arrow 32 to thus rotate the bobbin 2a in a clockwise direction, as seen in FIG. 2. At the same time, the motor 16a is caused to lower the rotary component or components 13a so as to enable the force of gravity to assist the pull upon the web 19a in order to rapidly and predictably transfer the bobbin 2a from the station which is defined by the receptacle 12 into the station 21 which is defined by the device 22. At such time, the clutch 53 is disengaged so as to prevent the transmission of torque to the pulley 27 and to thereby arrest the conveyors 26 and 26a. The pusher 36 is caused to perform a forward and return stroke before the fresh bobbin 2a enters the station 21 but after the sensor 62 has detected the trailing end of the web 19. This allows for unobstructed entry of the bobbin 2a into the station 21, i.e., into the pocket 31 which is defined by the corresponding flights of the conveyors 26 and 26a. The outermost convolution of the web 19a on the core of the bobbin 2a at the station 21 is contacted by the flights of the conveyors 26 and 26a at the locations 24 and 24a respectively. The conveyors 26, 26a are thereupon started by engaging the clutch 53 as soon as a sensor 63 indicates that the fresh bobbin 2a has entered the unwinding station 21. At such time, the web 19a advances at the speed which is required by the consuming machine because this web is pulled by the preceding web 19 which still travels through the nip of the unwinding or withdrawing rollers 49. Eventual shocks which develop as a result of acceleration of the bobbin 2a from zero speed to the speed which is necessary to adequately deliver the web 19a into the consuming machine are taken up by the spring-biased lever 48 for the dancer rollers 44 and 46.

If the transfer of the bobbin 2a from the receptacle 12 into the unwinding device 22 should be carried out at a relatively slow rate, i.e., if it is necessary to decelerate the web 19 in the region of the unwinding rollers 49 immediately after completion of the splicing operation at 41, the consuming machine can draw the web 19 from the reservoir 51 until the transfer of the bobbin 2a into the pocket 31 between the belt conveyors 26 and 26a is completed.

When the transfer of the bobbin 2a into the pocket 31 is completed, the motors 16 and 16a are actuated again so as to return the rotary components 13 and 13a to their lower end positions in which the receptacle 12 is ready to receive a fresh bobbin 2 from the magazine 1.

FIG. 2 further shows sensors 66 and 67 which monitor the loop 64 of wrapping material in the magazine 51 and transmit appropriate signals to the means for rotating the unwinding rollers 49 and the belt conveyors 26, 26a as a function of the quantity of stored wrapping material. The speed of the belt conveyors 26, 26a can be controlled by the clutch 53.

If the machine is to be arrested, the advancing or withdrawing rollers 49 and the conveyors 26 and 26a are brought gradually to a standstill. At such time, the kinetic energy of the bobbin 2a urges this bobbin deeper into the pocket 31 between the conveyors 26 and 26a so that the bobbin is braked and comes to a rapid halt. The angle $\alpha$ is preferably selected in such a way that the arrested conveyors 26 and 26a can ensure practically instantaneous or very rapid termination of rotation of the bobbin 2a without any, or with negligible, slippage.

The means (e.g., a control circuit) for receiving and evaluating signals from the sensors 56, 57, 58, 61, 62, 63, 66 and 67 and for transmitting appropriate signals to various motors is of conventional design and, therefore, is not specifically shown in the drawing.

An important advantage of the improved method and apparatus is that the expired bobbin (2b) can be replaced with a fresh bobbin (2a) in a time-saving operation and with a high degree of reliability. Moreover, the operation is such that the person in charge need not exert a substantial force in order to manipulate the leader of the web 19a at the station which is defined by the receptacle 12. Still further, the operation can be automated to any desired extent and the position of the bobbin at the unwinding station 21 is stable during normal operation as well as during acceleration, deceleration or stoppage of the machine which consumes or processes the web. In addition, it is not necessary to provide a separate drive in order to transfer a fresh web from the receptacle 12 into the unwinding device 22; such transfer is effected as a result of the exertion of a pull upon the leader of the web 19a and, if necessary, with assistance from the force of gravity by lowering the rotary component or components 13a so that the fresh bobbin 2a can roll out of the receptacle 12. The feature that the fresh bobbin 2a is set in rotary motion while it is still confined in the receptacle 12 is desirable and advantageous because this reduces the likelihood of breakage of the web in response to transfer into the unwinding device 22. Automation of the bobbin changing operation can begin in the magazine 1, at the station which is defined by the receptacle 12 or in the unwinding device 22.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for changing bobbins each of which has a core and a web which is convoluted on the core, whose leader is part of the outermost convolution and whose trailing end is adjacent the core, comprising a source of supply of fresh bobbins; a receptacle; means for delivering individual bobbins from said source to said receptacle; an unwinding device defining an unwinding station and having means for contacting the outermost convolution of the web on the bobbin at said unwinding station at a plurality of spaced-apart locations and means for rotating the bobbin so as to unwind the web from the bobbin at said station, said rotating means including means for transmitting to the web torque at one at least of said locations; means for holding the core at said station prior to expiration of the respective bobbin; and means for splicing the leader of the web in said receptacle to the trailing end of the web at such station upon expiration of the bobbin at said station so that the trailing end pulls the web and its bobbin in said receptable in a predetermined direction toward and into said station.

2. The apparatus of claim 1, wherein said contacting means comprises means for supporting the bobbin at said station at two spaced-apart locations such that the tangents to said two locations of the outermost convolution at said station form a pocket facing substantially counter to said direction.

3. The apparatus of claim 1, wherein said receptacle comprises means for engaging the outermost convolution of the web in said receptacle.

4. The apparatus of claim 3, wherein said engaging means comprises a plurality of substantially vertically movable supporting members which engage the outermost convolution of the web in said receptacle from below.

5. The apparatus of claim 4, wherein at least one of said supporting members includes at least one rotary component.

6. The apparatus of claim 4, wherein said receptacle further comprises means for moving said supporting members up and down independently of each other.

7. The apparatus of claim 6, wherein said moving means includes fluid-operated motors.

8. The apparatus of claim 4, wherein said receptacle and said unwinding device are adjacent each other and said receptacle is arranged to allow the bobbin therein to enter the unwinding station by gravity in response to lowering of at least one of said supporting members so that the force of gravity assists the pull of the trailing end which is spliced to the leader of the web in said receptacle in transferring the bobbin from said receptacle to said station.

9. The apparatus of claim 1, further comprising means for expelling the core from said station upon expiration of the respective bobbin.

10. The apparatus of claim 9, wherein said expelling means comprises a pusher.

11. The apparatus of claim 10, further comprising means for moving said pusher.

12. The apparatus of claim 10, wherein the means for moving said pusher comprises a fluid-operated motor.

13. Apparatus for changing bobbins each of which has a core and a web which is convoluted on the core, whose leader is part of the outermost convolution and whose trailing end is adjacent the core, comprising a source of supply of fresh bobbins; a receptacle; means for delivering individual bobbins from said source to said receptacle; an unwinding device defining an unwinding station and having means for withdrawing the web from the bobbin at said station, said withdrawing means including two mutually inclined unwinding members and said unwinding device further comprising means for supporting the bobbin at said station including means for contacting the outermost convolution of the web at said station at two spaced-apart locations such that the tangents to said locations of the outermost convolution at said station form a pocket facing substantially counter to said direction; and means for splicing the leader of the web in said receptacle to the trailing end of the web at said station so that the trailing end pulls the web and its bobbin in said receptacle in a predetermined direction toward and into said station.

14. The apparatus of claim 13, wherein at least one of said unwinding members comprises an endless conveyor.

15. The apparatus of claim 13, wherein at least one of said unwinding members comprises a plurality of endless belt conveyors.

16. The apparatus of claim 13, wherein said unwinding members make an acute angle.

17. The apparatus of claim 13, wherein said unwinding members constitute said supporting means and define said pocket.

18. Apparatus for changing bobbins each of which has a core and a web which is convoluted on the core, whose leader is part of the outermost convolution and whose trailing end is adjacent the core, comprising a source of supply of fresh bobbins; a receptacle; means for delivering individual bobbins from said source to said receptacle; an unwinding device defining an unwinding station and having means for withdrawing the web from the bobbin at said station, means for supporting the bobbin at said station including means for contacting the outermost convolution of the web at said station at two spaced-apart locations such that the tangents to said locations of the outermost convolution at said station form a pocket facing substantially counter to said direction, and means for driving said supporting means so as to unwind the web from the core at said station; and means for splicing the lead of the web in said receptacle to the trailing end of the web at such station upon expiration of the bobbin at said station so that the trailing end pulls the web and its bobbin in said receptacle in a predetermined direction toward and into said station.

19. The apparatus of claim 18, wherein said means for driving includes means for unwinding the web at said station at a first speed and said withdrawing means comprises means for drawing the web from said station at a higher second speed so that the web is tensioned between said withdrawing means and said supporting means.

20. The apparatus of claim 18, wherein said supporting means comprises discrete supporting elements which engage the outermost convolution of the web at said station at said plurality of locations, said driving means comprising means for driving said supporting elements at different speeds.

21. Apparatus for changing bobbins each of which has a hollow core and a web which is convoluted on the core, whose leader is part of the outermost convolution and whose trailing end is adjacent the core, comprising a source of supply of fresh bobbins; a receptacle; means for delivering individual bobbins from said source to said receptacle; an unwinding device defining an unwinding station and having means for withdrawing the web from the bobbin at said station; means for splicing the leader of the web in said receptacle to the trailing end of the web at such station upon expiration of the bobbin at said station so that the trailing end pulls the web and its bobbin in said receptacle in a predetermined direction toward and into said station; and means for holding the core at said station prior to expiration of the respective bobbin, said holding means comprising a mandrel and means for introducing the mandrel into the core at said station.

22. The apparatus of claim 21, wherein said introducing means comprises a motor.

23. The apparatus of claim 22, wherein said motor includes a fluid-operated motor.

24. Apparatus for unwinding bobbins of the type wherein a core is surrounded by the convolutions of a web, comprising an unwinding device having means for supporting the outermost convolution of the bobbin at a plurality of spaced-apart locations such that the tangents to the outermost convolution at said locations define a pocket which is open in a predetermined direction, said supporting means comprising a plurality of endless belt conveyors which contact the outermost convolution of the web at said locations and make an acute angle in the region of said pocket, and means for drawing the web off the core in said unwinding device counter to said direction.

25. The apparatus of claim 24, further comprising means for driving at least one of said conveyors in a direction to unwind the web from its core.

* * * * *